US006006650A

United States Patent [19]

Adams

[11] Patent Number: 6,006,650

[45] Date of Patent: Dec. 28, 1999

[54] POWER CONTROL APPARATUS FOR A SLIDING DOOR

[76] Inventor: Ronald A. Adams, 11950 N.W. 27th St., Ft. Lauderdale, Fla. 33323

[21] Appl. No.: 08/772,277

[22] Filed: Dec. 20, 1996

[51] Int. Cl.[6] ..... F15B 11/08

[52] U.S. Cl. ..... 91/446; 91/461

[58] Field of Search ..... 91/444, 446, 461

[56] References Cited

U.S. PATENT DOCUMENTS 4,479,678 10/1984 Sharp ..... 91/461 X
4,489,640 12/1984 Olson ..... 91/189 R
4,882,876 11/1989 Daugirdas ..... 49/141
5,184,535 2/1993 Kimura ..... 91/461 X
5,349,151 9/1994 Eisbrenner et al. ..... 91/461 X

*Primary Examiner*—Hoang Nguyen

[57] ABSTRACT

Control apparatus is provided for pneumatically operating a sliding door on a marine vessel. A dual pneumatic system provides for a first pressure to operate the switching mechanisms of the control apparatus, while a second lower pressure provides for operation of a pneumatic cylinder to achieve door travel. Operation of the door may be controlled from either side of the door. Upon loss of pneumatic pressure, the control apparatus provides for relieving of the pressure to allow manual operation of the door. In a manual state of operating, flow controls are provided to regulate door travel in accordance with external force applied to the door. Controlled low pressure maintains the door in an open or a closed position.

12 Claims, 2 Drawing Sheets

POWER CONTROL APPARATUS FOR A SLIDING DOOR

BACKGROUND OF THE INVENTION

1. Field of the Invention

This invention pertains in general to the field of pneumatic apparatus for operation of a door and in particular to a pneumatic control mechanism for opening and closing a sliding door on a nautical vessel.

2. Description of the Prior Art

A large number of boats include at least one sliding door between the outside deck of the boat and the inside of a cabin. On larger boats or ships, many such sliding doors are used. In such applications, a sliding door is preferred over a hinged, swinging type of door because of space considerations and the negative aspects of a hinged door suddenly swinging in either direction due to rolling seas. A swinging door could severely injure a person when he or she is trying to enter or exit through such door when the rolling of the boat due to rough seas suddenly swings the door toward the person.

While sliding doors are preferred on a marine vessel, they are also subject to rapid opening or closing in an unrestrained condition due to rough seas. Thus, when a sliding door is unlatched, it will slide back and forth in its tracks depending upon the rolling or pitching motion of the boat and the location of the door. The result is that the door slams open or closed with a great deal of force. If a person is attempting to pass through the doorway associated with such a sliding door at the same time the boat is rocking, it is very probable that the person will be injured. Moreover, the constant rocking of the boat and therefore the slamming back and forth of a sliding door can cause damage to the boat and the door.

In order to negate the force effects of an unrestrained sliding door, the usual practice is to latch the door either in an open or a closed position. Latching of a sliding door is not, however, a complete solution to the problem. For example, when a latched-shut door is unlatched, preparatory to being open to allow a person or persons to pass therethrough, the rocking and/or rolling movement of the boat causes the door to move rapidly in either or both directions. To overcome this effect, the person must hold onto the edge of the door in an attempt to control the forceful motion of the door. Frequently, the person himself is trying to maintain his own balance and trying to control the movement of the door at the same time. Often, the result is a clumsy effort which is not successful and the door may slam against some part of the person causing him serious injury.

With the sliding door latched in an open position, passage therethrough in a safe and orderly manner is assured. But, the negative effects of the door always being open exist. The disadvantages of a latched-open door during foul or rainy weather conditions is obvious. Besides, why have a door if it is in the open position at all or most times?

In the prior art, most of the door control apparatus is designed for swinging doors. However, the door control apparatus intended for use with a swinging door is not adaptable to a sliding door, particularly where the swinging door apparatus includes articulated lever arms. In the category of door control apparatus which is adaptable to a sliding door, that is, those door controls which utilize a piston and cylinder which move in an axial direction, such prior art apparatus do not satisfactorily control the motion of a sliding door on a boat. There are a number of reasons for this deficiency. One is that the door apparatus will bias the door in either the open or closed direction while requiring force to move the door in the other direction. Therefore, with this type of door control apparatus, either a shut door or open door condition is imposed the opposite condition is achieved by overcoming the biased spring force and the hydraulic pressure force. To compensate for this condition, pneumatic pressure bleeding valves are incorporated in the pneumatic mechanism and/or a double-acting piston is used. While such apparatus does exist in the prior art, it does not offer a complete solution. One problem comprises a loss of power, either electrical or pneumatic. A loss of power could freeze the door in a closed position, which is totally unacceptable in an emergency. Another problem concerns the force used to close the door. A high force which may be necessary in rolling seas could injure a person momentarily stuck in the door opening.

Accordingly, a primary object of the present invention is to provide pneumatic control apparatus for a sliding door particularly adapted for marine use.

Another object of the present invention is to provide pneumatic control apparatus for use with a sliding door which allows for emergency manual opening or closing of the door.

Another object of the present invention is to provide pneumatic control apparatus for a sliding door which is fail-safe.

Another object of the present invention is to provide pneumatic control apparatus for a sliding door which prevents injury to a person from the force of closing the sliding door.

The above-stated objects as well as other objects which, although not specifically stated, but are intended to be included within the scope of the present invention, are accomplished by the present invention and will become apparent from the hereinafter set forth Detailed Description of the Invention, Drawings, and the claims appended herewith.

SUMMARY OF THE INVENTION

The present invention accomplished the above-stated objectives in solving the problems of the prior art by providing pneumatic control apparatus for a sliding door particularly adapted for marine use comprising a two-stage pressure arrangement. Control valving is provided which allows the mechanism to revert to manual operation upon a loss of pneumatic pressure. A first high pressure is utilized to operate valving, while a second low pressure is used to control the door opening and closing. Controlled low pressure is used to hold the door in either an open or closed position. External and internal buttons control the opening and the closing of the sliding door.

BRIEF DESCRIPTION OF THE DRAWINGS

Various other objects, advantages and features of the invention will become apparent to those skilled in the art from the following discussion taken in conjunction with the following drawings in which.

DESCRIPTION OF THE PREFERRED EMBODIMENTS

As required, detailed embodiments of the present invention are disclosed herein; however, it is to be understood that the disclosed embodiments are merely exemplary of the invention which may be embodies in various forms. Therefore, specific structural and functioning details disclosed herein are not to be interpreted as limiting, but merely as a basis for the claims and as a representative basis for teaching one skilled in the art to variously employ the present invention in virtually any appropriately detailed structure.

Figure 1:
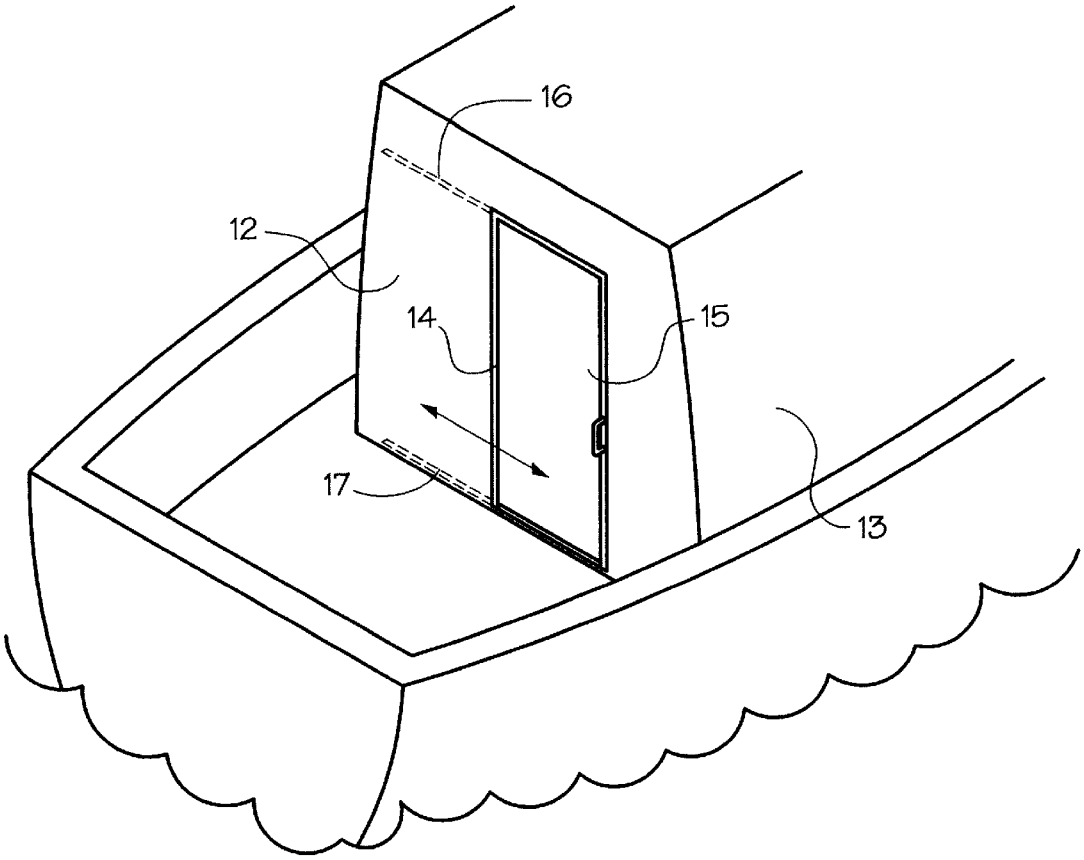
FIG. 1 comprises an isometric view of a partial portion of a small cabin cruiser which utilizes a sliding door for access into and out of the cabin to which the pneumatic control apparatus of the present invention may be used.

Referring now to FIG. 1 of the drawings, there is schematically shown therein a portion of a small cabin cruiser 11 to which the inventive door control apparatus is to be attached. A wall 12 of cabin 13 has a sliding door 14 operatively associated therewith. Door 14 is shown in the closed position covering passageway 15. Door 14 may of course comprise any sliding door used on a boat or a ship. Typically, sliding door 14 slides on upper 16 and lower rails 17 associated with passageway 15, such that door 14 slides sideways as indicated by the arrows 17 in FIG. 1. A typical double-acting pneumatic cylinder 18 is operatively attached to wall 12 and door 14. Pneumatic pressure applied to one end of cylinder 18 opens the door while pneumatic pressure applied to the other end of cylinder 18 closes the door. A flow control valve is located at each end of the pneumatic cylinder which serves to vent the pressure and to control the speed of opening and closing door 14.

Figure 2:
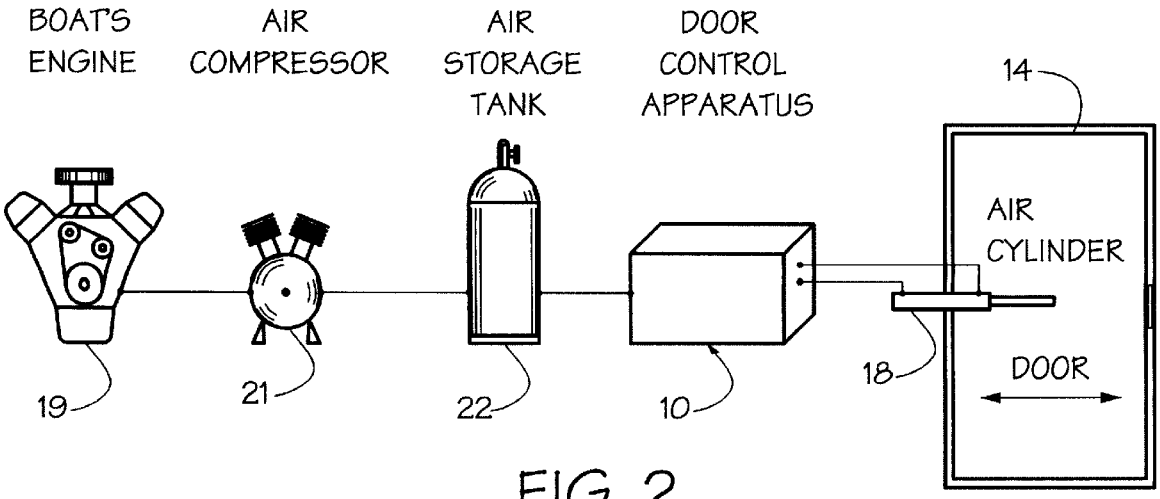
FIG. 2 is a schematic block diagram of the system and apparatus to which the inventive pneumatic control apparatus is applies.

FIG. 2 schematically illustrates the overall flow arrangement of the pneumatic pressure to operate door 14. The engine 19 of the boat 11 (or an auxiliary power source) is used to power an air compressor 21. Compressed air from air compressor 21 is received by and stored in an air storage tank 22. Typically, the pneumatic pressure of the air in storage tank 22 is of the order of 80 to 100 psi. The pressurized air is then supplied to the inventive control apparatus 10 which in turn directs the operation of hydraulic cylinder 18 to open or close door 14.

Figure 3:
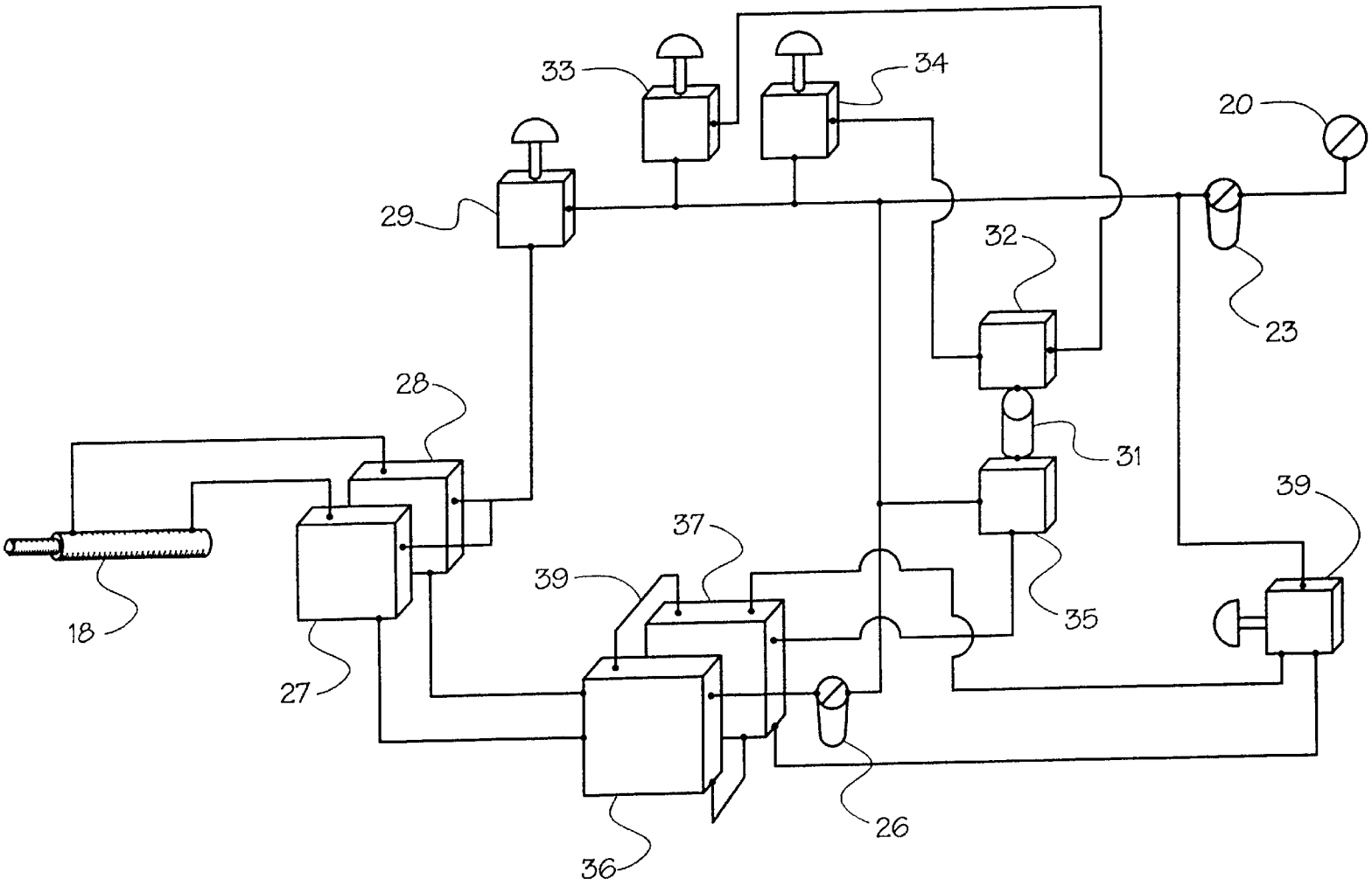
FIG. 3 is a schematic front view of a panel having arranged thereon the individual components of the pneumatic control apparatus according to the present invention.

The inventive door control apparatus 10 shown in FIG. 3 receives high pressure air through a ball valve 20 which is a simple manual open and close valve. Valve 20 provides for the pressurized air from air cylinder 22 to enter the door control apparatus 10. The high pressure air is then input to a first pressure regulator 23 which may comprise a combination filter, lubricator and regulator. Pressure regulator 23 reduces the air pressure to that of the operating pressure of the valve switching mechanism 24 which may be on the order of 50–80 psi. The 50–80 psi air is directed to a first pilot-operated four-way valve 36 through a second regulator 26. The second regulator 26 reduces the 50–80 psi pressure to approximately 15–25 psi. The low pressure air from the second regulator 26 is used to power the pneumatic cylinder 18 which opens and closes door 14.

In order for the door 14 to be operated by the door control apparatus 10, a pair of three-way normally closed air pilot valves 27 and 28 must first be energized. This is accomplished by an on/off button 29. On/off button 29 is flow-connected to the pilots of the pair of three-way air pilot operated valves 27 and 28. Upon a loss of air pressure, valves 27 and 28 vent to the atmosphere.

The 50–80 psi air from first regulator 23 is also input to a three-way normally closed valve 35. Valve 35 is normally closed and activated by a snap-action valve 31, which automatically resets itself. A shuttle valve 32 activates snap-action valve 31, which in turn opens normally closed valve 35. Shuttle valve 32 receives air signals from a pair of door-operating buttons 33 and 34 which direct air into a respective one of two inlet ports of shuttle valve 32. Either of door switches 33 or 34 opens or closes door 14. The air from valve 35 is input to four-way double air pilot operated valves 36 and 37. Valves 36 and 37 are connected to each other as shown by lines 38 and 39 when the outputs of valve 37 are input to the pilots of valve 36. Valve 37 thus directs the operation of valve 36 as regards which direction door 14 is to move. Valve 36, it is to be remembered, receives 15–25 psi air through regulator 20.

A three-way door reversing switch 39 comprising a two postition switch connected to a three way air valve, inputs air signals to the pilot of valve 37. Air is supplied to switch 39 from the first pressure regulator 23. Switch 39 is arranged such that when door 14 opens or closes, switch 39 is activated to reverse the direction of door movement when either one of door button switches 33 or 34 is thereafter pushed. The signals from switch 39 are input to the pilots of valve 37 and are used by valve 37 to direct the operation of valve 36. Valve 36 outputs air to each of valves 27 and 28.

Provided that on/off switch 29 has been activated, a signal from valve 36 is output to either valve 27 or 28. One of valves 27 or 28 is connected to one end of cylinder 18, the other is connected to the other end of cylinder 18. Thus, the output of valve 36 controls the direction of movement of door 14. It is to be remembered that the output of valve 36 is controlled by valve 37, which in turn is controlled by valve switch 39.

The door button switches 33 and 34 may be positioned on one side of door 14 and the other on the other side of door 14. The reversing switch 39 may be located, for example, at the side of the door frame where it comes into contact with the edge of the door 14 when it is fully opened. In this manner, the opening or closing of the door may be operated from either side thereof by simply pushing the door button switch 33 or 34 located on that side, regardless of the position of the door at any time.

The control apparatus 10 above described utilizes relatively low pressure air (on the order of 40–80 psi) to activate the various switching and control valves which control the air directed to the cylinder which opens and closes door 14. The system also provides for a low-pressure air on the order of 15–25 psi, to be utilized by cylinder 18 to open and close door 14. The use of low pressure air to operate cylinder 18 prevents injuries to persons who might be trapped within the door opening 15 while the door 14 is being closed. That is, the force applied by the door when closing is sufficiently small to allow a person to manually stop the door closing operation by simply using his hand to hold the door in its then position or even force the door back open.

The operation of the inventive control apparatus 10 is as follows: The system is activated by pushing on/off switch 29. At this time it will be assumed that door 14 is closed. A person from 31 which, in turn, opens valve 35. Snap-action valve automatically resets itself awaiting another signal. Air from valve 35 flows to valve 37. Switch 39 informs valve 37 that the door is closed. Valve 37 therefore directs valve 36 to supply air to valve 27 which is assumed to be connected to the side of cylinder 18 which opens door 14.

Once inside the cabin, the person pushes button 34. This sends a signal to shuttle valve 32, which again directs snap-action valve 31 to activate valve 35. The signals input to valve 37 from valve 35 and switch 39 cause valve 37 to direct valve 36 to flow air through valve 28 which is connected to the side of the cylinder 18 which closes door 14.

Because of the signals output by the door-reversing switch and the arrangement of the activation and control valves of control apparatus 10, the door 14 may be: opened and closed from the same side, or opened from one side and closed from the other side, or closed from one side and opened from the other side. The system automatically accounts for the then position of the door 14 and allows an opposite direction of movement of the door 14 from either side thereof. Should the system pressure by lost, the valves 27 and 28 vent to atmosphere which relieves the pressure within cylinder 18 and thereby provides for manual operation of the door 14.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the scope of the breadth and scope of the claims here appended.

I claim as my invention:

1. Control apparatus for pneumatically operating a sliding door comprising a first pressure for controlling the operation of valving and switches, a second pressure for controlling movement of the door, said valving comprising first valve means operatively connected to door open and close switch means, a second valve means operatively connected to a door direction reversal switch and third valve means operatively connected to a pneumatic cylinder which is connected to said door for controlling said sliding movement.

2. The control apparatus of claim 1 including first and second pressure regulators for respectively controlling said first and second pressures.

3. The control apparatus of claim 1 including a switch for activating said third valve means.

4. The control apparatus of claim 1 wherein said door open and close switch means comprises two switches for opening and closing said door from either side thereof.

5. The control apparatus of claim 1 wherein said first valve means comprises a two-way shuttle valve connected to a snap-action switch which is connected to a normally closed three-way valve.

6. The control apparatus of claim 1 wherein said second valve means comprises a pair of four-way valves, a first of which receives signals from the first valve means and the door reversal switch.

7. The control apparatus of claim 6 wherein a second of said pair of four-way valves receives signals from said first valve and sends a signal to direct the operation of said third valve means.

8. The control apparatus of claim 1 wherein said third valve means comprises a pair of three-way normally closed valves, which receive operating signals from said second valve means.

9. The control apparatus of claim 1 wherein said door reversal switch comprises a two-position switch connected to a three-way valve having one input port, a normally closed output port and a normally open output port.

10. The control apparatus of claim 9 wherein said normally closed and normally open ports are connected to said second valve means.

11. The control apparatus of claim 5 wherein a first output port of said three-way valve is connected to said second valve means and a second output port of said three-way valve is connected to said second pressure regulator which in turn is connected to said second valve means.

12. The control apparatus of claim 8 wherein the output of a first of a pair of valves is connected to one end of said pneumatic cylinder, and the output of a second of said pair of valves is connected to a second end of said pneumatic cylinder.

* * * * *